US007740150B2

(12) United States Patent
Schnarr, III et al.

(10) Patent No.: US 7,740,150 B2
(45) Date of Patent: Jun. 22, 2010

(54) HOLSTER FOR HOT MELT DISPENSING HANDGUN

(75) Inventors: John H. Schnarr, III, Alpharetta, GA (US); John M. Raterman, Atlanta, GA (US)

(73) Assignee: Nordson Corporation, Westlake, OH (US)

( * ) Notice: Subject to any disclaimer, the term of this patent is extended or adjusted under 35 U.S.C. 154(b) by 740 days.

(21) Appl. No.: 11/557,280

(22) Filed: Nov. 7, 2006

(65) Prior Publication Data

US 2008/0105709 A1 May 8, 2008

(51) Int. Cl.
*B67D 1/00* (2006.01)
*B67D 7/80* (2006.01)

(52) U.S. Cl. ..... 222/52; 222/146.5; 219/242

(58) Field of Classification Search ..... 222/54, 222/146.1, 146.2, 146.5, 173, 179.5, 52; 248/176.2; 224/191; 219/221, 229, 242
See application file for complete search history.

(56) References Cited

U.S. PATENT DOCUMENTS 5,811,766 A * 9/1998 Fabrikant et al. ..... 219/521
6,041,972 A * 3/2000 Maayeh et al. ..... 222/173
6,152,386 A 11/2000 Bullock et al.
6,169,272 B1 * 1/2001 Racine et al. ..... 219/424
6,877,681 B2 4/2005 Hartle et al.
6,938,795 B2 9/2005 Barton, Jr. et al.
2002/0130143 A1 * 9/2002 Schouten et al. ..... 222/327
2004/0245243 A1 * 12/2004 Ossanna ..... 219/521
2007/0119865 A1 * 5/2007 Belanger et al. ..... 222/146.5

OTHER PUBLICATIONS

Nordson Corporation; Select Series AD-41-H Dispensing Handguns and Hoses; Nov. 2005; 3 pages.
Nordson Corporation; Series AD-31 Handguns; Dec. 2001; 2 pages.
Nordson Corporation; redacted drawings; 2 sheets.
EFD, A Nordson Company; Dispensing Products—Fluid dispensers; Copyright 2007; 2 pages.

* cited by examiner

*Primary Examiner*—Kevin P Shaver
*Assistant Examiner*—Daniel R Shearer
(74) *Attorney, Agent, or Firm*—Wood, Herron & Evans, L.L.P.

(57) ABSTRACT

A holster is provided for use with a hot melt dispensing handgun having a nozzle, with the holster including a body defining a cavity and further including a nozzle garage. The body is operable for receiving at least a portion of a handgun within the cavity and for supporting the handgun when the handgun is inactive. The nozzle garage has a housing defining a hollow interior communicating with the cavity and also includes a heating element. The nozzle garage is operable for receiving at least a portion of a nozzle within the hollow interior and for heating the nozzle of the handgun when the handgun is inactive.

26 Claims, 6 Drawing Sheets

HOLSTER FOR HOT MELT DISPENSING HANDGUN

FIELD OF THE INVENTION

The present invention relates generally to holt melt dispensing systems, and more particularly, to devices for holding hot melt dispensing handguns.

BACKGROUND

Thermoplastic materials include those materials that can be repeatedly melted and cooled to a solid. Thermoplastic material includes thermoplastic adhesives, sealants and waxes, referred to as "hot melt" materials. "Hot melt" materials are used in a wide variety of applications including the assembly of various types of products including furniture, doors, windows, automotive trim, etc., and the closing of boxes, containers, etc.

Typically, solid hot melt material, in various shapes and sizes, is supplied to a melter that includes a heated tank and/or a heated grid to produce molten hot melt material. Solid hot melt material can also be supplied in drums or barrels in which the material is melted by the use of a platen. After heating, the molten material can be pumped through a heated hose, to maintain the molten material at the required application temperature, to an applicator or dispenser, sometimes referred to as a "dispensing gun" or gun, dispensing handgun, or a gun module, comprising a valve and a nozzle.

Dispensing handguns can have various configurations that include top-feed and bottom-feed configurations that refer to the location on the handgun where a heated hose supplying hot melt material is connected to the handgun. Handguns of the foregoing type have been successfully used in many applications but their use can present manufacturing challenges in some instances. For example, it may be necessary to attach a relatively long nozzle to the end of the handgun barrel to apply the adhesive or sealant in "hard-to-reach" locations. Nozzles of this type can be about one to six inches in length for example. The handgun typically includes a heater, which can be a cartridge-type heater inside the barrel where the heated hose is coupled to the handgun. The heater maintains the hot melt material at the desired temperature and resultant viscosity.

The time between successive uses of the handgun can vary depending upon the particular production rate and can be affected by other factors such as lunch breaks, shift changes, etc. In some instances, the time between successive uses of the handgun can be long enough that there is a significant drop in temperature of the hot melt material in the nozzle as compared to the material in the handgun barrel. This can adversely affect the viscosity and flow characteristics of the hot melt material present in the nozzle such that it may not be useable. This problem is often resolved by depressing the handgun trigger for a sufficient period of time that a pump upstream of the heated hose, which is coupled to the handgun, forces the reduced temperature material out of the nozzle. While this procedure eliminates the unusable material in the nozzle, it results in additional material losses due to the nozzle purging and lost production line time, each of which adds to the cost of the production operation.

Also, handguns of the foregoing type, in particular bottom-feed handguns, may be subject to damage as a result of inadvertent misuse. Top-feed handguns may be hoisted upward after use and are less susceptible to damage. However, hoisting bottom-feed handguns overhead between applications is not practical due to the routing of the heated hose coupled to the handgun. If the handgun is placed on a workstation it may be pulled off due to the weight of the heated hose, which may result in damage to the handgun. Placing the handgun on the floor is also undesirable as a worker may inadvertently step on the handgun.

SUMMARY

According to a first aspect of the present invention, a holster is provided for use with a hot melt dispensing handgun having a nozzle, with the holster comprising a body defining a cavity. The body is adapted to receive at least a portion of a handgun within the cavity and for supporting the handgun when the handgun is inactive. The holster further comprises a nozzle garage comprising a housing defining a hollow interior that communicates with the cavity and further comprising a heating element. The nozzle garage is adapted to receive at least a portion of a nozzle of the handgun within the hollow interior and is operable for heating the nozzle when the handgun is inactive.

In other embodiments, the holster can include one or more additional features. For example, the holster can further include at least one mounting device secured to the holster body, which is adapted to mount the holster on a structure. The holster body includes first and second sides and the holster can include a pair of the mounting devices, with each being secured to one of the sides of the holster body.

The nozzle garage can be releasably secured to the holster body. Alternatively, the housing of the nozzle garage and the holster body can be integrally formed as a one-piece construction. The holster body can be made of a thermal insulator.

The holster body comprises an open top and at least a portion of the handgun is insertable into the cavity through the open top and the body is adapted to receive at least a portion of a barrel of the handgun within the cavity. The holster can include an open end adapted to permit a conduit to be coupled to the barrel of the handgun when the barrel is at least partially disposed within the cavity. In another embodiment this coupling can be permitted by a partially open end of the holster. The holster can include at least one sensor operable for sensing the presence of the handgun within the cavity of the body. The sensor can be operable for sending a signal to a controller which activates the heating element when the presence of the handgun with the cavity is sensed.

The heating element can be a cartridge heater embedded in the housing of the nozzle garage. Alternatively, the housing can comprise a positive-temperature-coefficient material, with this material being the heating element.

According to a second aspect of the present invention, a hot melt dispensing system is provided comprising a hot melt dispensing handgun comprising a nozzle and a holster comprising a body defining a cavity. The body of the holster is adapted to receive at least a portion of the handgun within the cavity and for supporting the handgun when the handgun is inactive. The holster further comprises a nozzle garage comprising a housing defining a hollow interior communicating with the cavity of the holster body. The nozzle garage further comprises a heating element. The nozzle garage is adapted to receive at least a portion of the nozzle of the handgun within the hollow interior and is operable for heating the nozzle of the handgun when the handgun is inactive.

In other embodiments, the hot melt dispensing system can include one or more additional features. For example, the handgun can include a barrel, with the nozzle releasably secured to the barrel. The system can further include a heated hose mechanically and fluidicly coupled to the barrel of the handgun and a pump in fluid communication with the heated hose, with the heated hose being operable for delivering hot melt material to the barrel. The holster can further include one or more of the additional features discussed previously with regard to the first aspect of the present invention.

BRIEF DESCRIPTION OF THE DRAWINGS

The present invention will become better understood with regard to the following description, appended claims and accompanying drawings of illustrative embodiments of the invention wherein:

DETAILED DESCRIPTION

Figure 1:
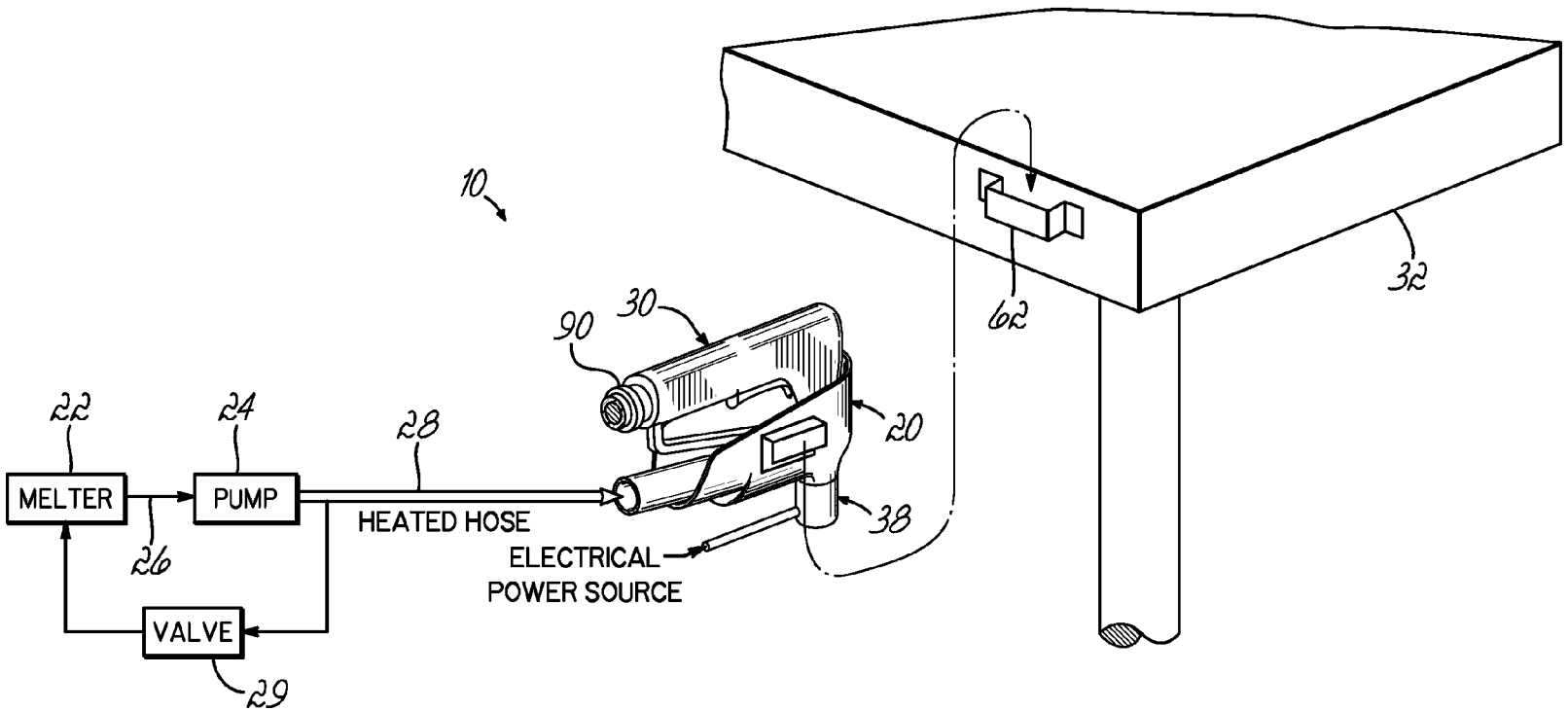
FIG. 1 illustrates a hot melt dispensing system incorporating a holster according to an embodiment of the present invention, with a portion of the system shown schematically and a portion shown in perspective view.

FIG. 1 illustrates a hot melt dispensing system 10 incorporating a holster 20 according to an illustrative or exemplary embodiment. System 10 may include a melter 22 that receives solid particles of a thermoplastic material that can be an adhesive, a sealant or a wax, for example, and is effective for melting the solid particles into a molten liquid material. Melter 22 can assume any of a variety of conventional configurations. Melter 22 is in fluid communication with a pump 24, via a fluid conduit 26 in the illustrated embodiment, so that the molten material is supplied to an inlet of pump 24. The melter 22 and pump 24 are positioned relative to one another so that the hot melt material can flow from melter 22 to the inlet of pump 24 in a conventional manner, such as by gravity feed.

The molten hot melt material is pumped through a conduit 28 to a hot melt dispensing handgun 30 that can be disposed within holster 20 when handgun 30 is inactive, i.e., is not being used by an operator to apply the hot melt material to a work piece. System 10 can also include a pressure dump valve 29 that is located downstream of pump 24 and is in fluid communication with conduit 28 and melter 22. Valve 29 is closed during operation of system 10 and can be opened when system 10 is not operating as subsequently discussed. Holster 20 can be removably mounted to a structure, such as a work table 32, as subsequently discussed in greater detail. Conduit 28 can be a flexible heated hose incorporating sufficient heating elements to maintain the hot melt material within the range of operating temperatures that produce the desired viscosity and associated flow characteristics of the hot melt material. The system 10 can include sufficient temperature sensors (not shown), which can be resistance temperature detector (RTD) sensors, and an associated controller (not shown) coupled to the temperature sensors and the heating elements, to maintain the desired operating temperature of the material within the hose 28, as known in the art.

Figure 2:
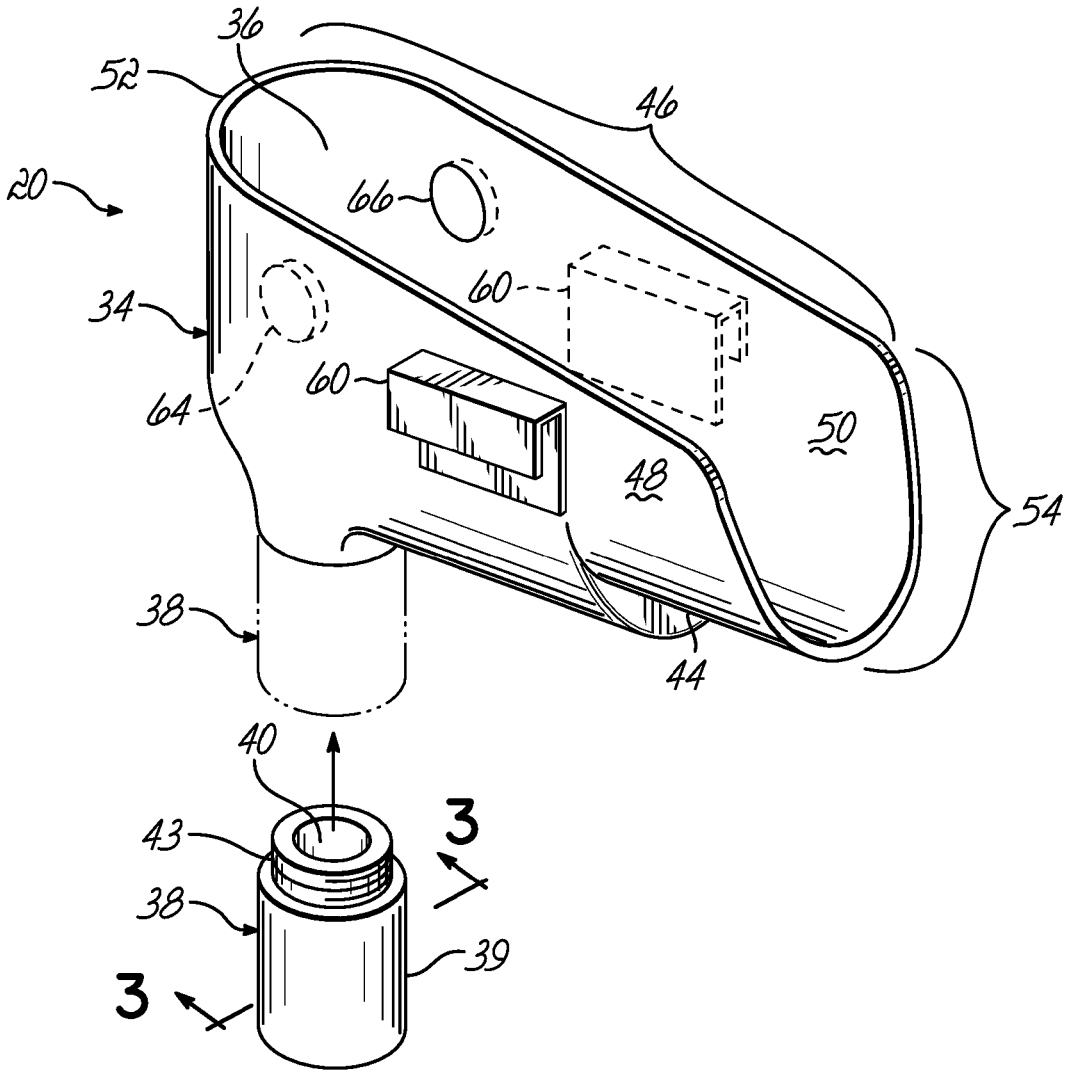
FIG. 2 is a perspective view of the holster shown in FIG. 1, with the included nozzle garage being shown in exploded assembly view.
Figure 3:
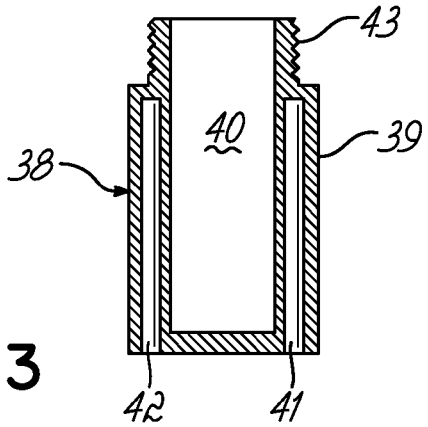
FIG. 3 is a cross-sectional view taken along line 3-3 in FIG. 2.
Figure 4:
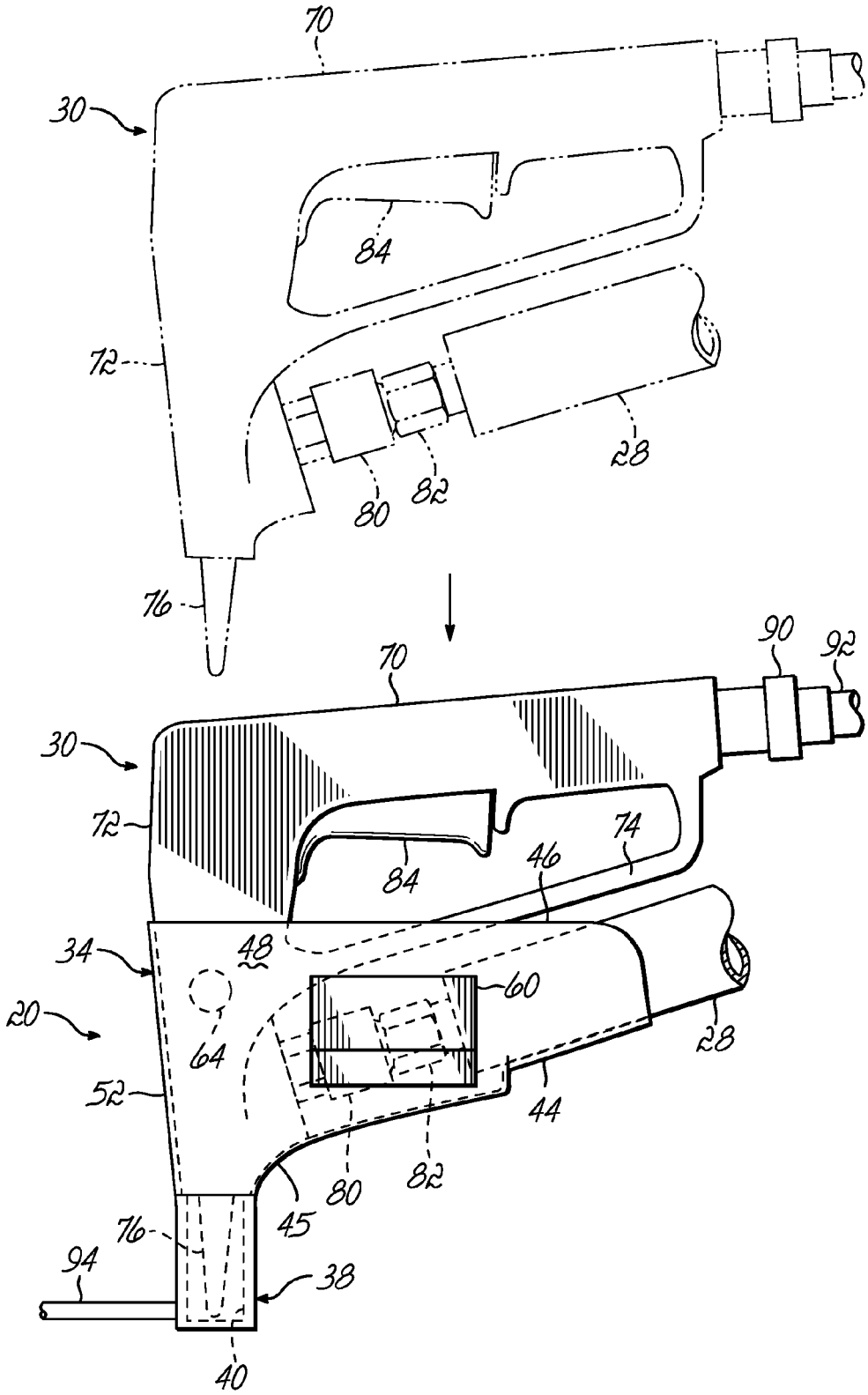
FIG. 4 is a side elevation view of the holster shown in FIGS. 1, 2 and 3, illustrating a hot melt dispensing handgun being inserted into the holster.

FIGS. 2, 3 and 4 further illustrate the holster 20 shown in FIG. 1. Holster 20 includes a body 34 defining a cavity 36 and further includes a nozzle garage 38 having a housing 39 that defines a hollow interior 40 that communicates with cavity 36. Nozzle garage 38 also includes at least one heating element. In the illustrative embodiment, nozzle garage 38 includes a heating element 41 embedded into housing 39 as illustrated schematically in FIG. 3. Additional heating elements can also be included in nozzle garage 38. Heating element 41 can be a cartridge heater, or other suitable heater. Additionally, nozzle garage 38 can include one or more temperature sensors operable for measuring the temperature of housing 39. In the illustrative embodiment, nozzle garage 38 includes one temperature sensor 42, which can be an RTD sensor. Sensor 42 and heating element 41 can be electrically coupled to a controller (not shown) such as a programmable logic controller.

Alternatively, heating element 41 can be omitted from nozzle garage 38 and the housing 39 of nozzle garage 38 can be made of a substrate material and a positive-temperature-coefficient (PTC) material deposited onto the substrate material using conventional techniques. The PTC material is a heating element. Various PTC materials, as well as the compatible substrate materials, are known in the art. When a PTC material is used, a power supply (not shown) is electrically coupled to the PTC material. PTC materials experience a rapid increase in electrical resistance when their temperature is raised such that elements made of PTC material act as their own thermostat when reaching their maximum temperature, as known in the art. In view of this self-regulating characteristic of PTC materials, it is not necessary to provide a dedicated temperature control circuit for nozzle garage 38 when housing 39 is made of a substrate material and a PTC material deposited onto the substrate material.

Figure 2A:
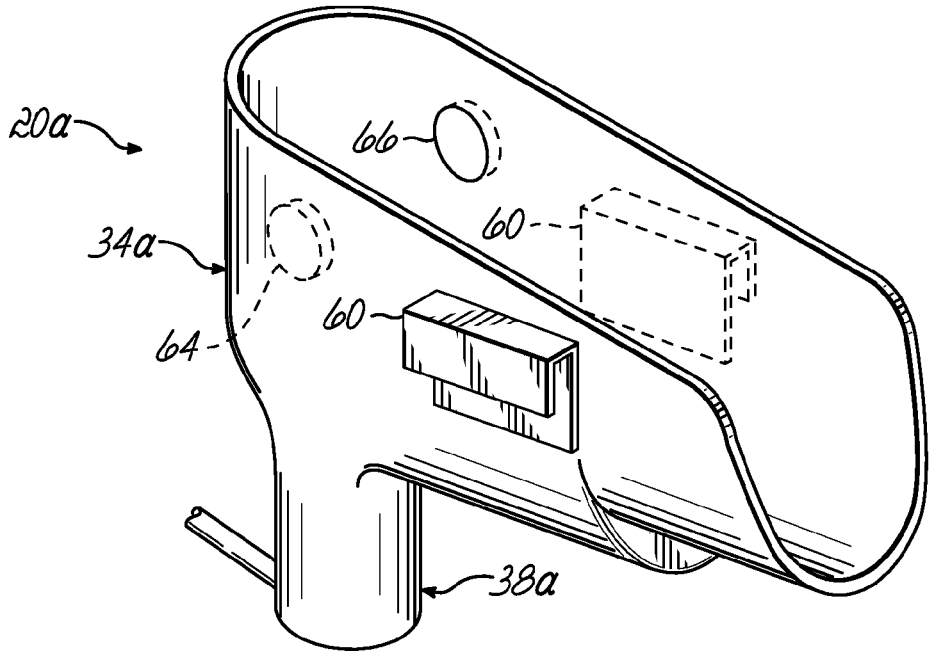
FIG. 2A is a perspective view of a holster according to another embodiment of the present invention.

The nozzle garage 38 can be releasably secured to body 34 of holster 20. For example, as shown in FIG. 3, the nozzle garage 38 can be threaded onto body 34, which includes threads (not shown) that mate with threads 43 formed on the nozzle garage 38. Other means can also be used to releasably secure the nozzle garage 38 to body 34. Alternatively, the body and housing of the nozzle garage can be integrally formed with one another as a one-piece construction as shown in FIG. 2A with regard to holster 20*a*. Holster 20*a* includes body 34*a* and nozzle garage 38*a* that are integrally formed with one another and accordingly do not include mating threads but can otherwise be configured generally the same as body 34 and nozzle garage 38.

In the illustrative embodiment, body 34 of holster 20 further includes a bottom 44, an open top 46, first 48 and second 50 sides extending between bottom 44 and top 46, a closed end 52 extending between sides 48, 50 from bottom 44 to top 46 and an open end 54. Bottom 44 includes a fillet radius 45 (FIG. 4).

Holster 20 can further include at least one mounting device 60 that is adapted to mount holster 20 on a structure such as work table 32. In the embodiment shown in FIGS. 2-4, holster 20 includes two mounting devices 60 and is releasably mounted on work table 32. One mounting device 60 is secured to side 48 of body 34 and the other mounting device 60 is secured to side 50 so that holster 20 can be mounted to a structure such as work table 32 at a position that provides easy access to handgun 30 for either a left-handed or right-handed operator. In the illustrative embodiment each mounting device 60 is a bracket having a generally inverted U-shape that can engage a mating bracket 62 on a structure such as work table 32. However, a variety of other mounting devices can be secured to sides 48, 50 of body 34 that can include brackets having other configurations, snaps, straps, pins, cables and other suitable devices. Further, holster 20 can be fixedly mounted on a structure such as work table 32 by conventional means such as fasteners, etc., and one or more mounting devices can be secured to the closed end 52 for the purpose of mounting holster 20 on a structure such as work table 32.

Holster 20 can also include one or more proximity sensors that are operable for sensing the presence of handgun 30 within cavity 36 of holster 20. The proximity sensor(s) can be electrically coupled to a controller (not shown) or other logic circuitry. The controller can be a programmable logic controller that can control the operation of various components of hot melt dispensing system 10 such as pump 24, pressure dump valve 29 and any heating element(s) of nozzle garage 38 or nozzle garage 38*a*. Many types of proximity sensors can be used with holster 20. In the illustrative embodiment, the proximity sensor of holster 20 includes sensors 64 and 66 illustrated schematically in FIGS. 2, 2A and 4. Sensors 64, 66 can be secured to body 34 of holster 20. One of the sensors 64, 66 can be a light-emitting transmitter, while the other of sensors 64, 66 can be a receiver. When the light beam is interrupted due to the presence of handgun 30 within cavity 36 of holster 20, an electrical pulse or signal is sent to the controller.

Alternatively, the proximity sensor of holster 20 can be a single unit that includes a light-emitting transmitter and a receiver, and handgun 30 can include a reflective surface that reflects the light back to the receiver indicating the presence of handgun 30 within holster 20. Other alternative proximity sensors can be used to sense the presence of handgun 30 within cavity 36 of holster 20. For example, inductive or capacitive based proximity sensors may be used. As a further alternative, one or more mechanical type switches may be located in cavity 36 such that handgun 30 closes the switch contact when handgun 30 is present in cavity 36. As another alternative, holster 20 can include one or more temperature sensors to sense the presence of handgun 30 within cavity 36. The functions of the foregoing proximity sensor or other sensors of holster 20 is discussed subsequently.

In the illustrative embodiment, handgun 30 is a Series AD-41 Dispensing Handgun made by Nordson Corporation, which is the assignee of the present invention. Handgun 30 is represented schematically in FIGS. 1 and 4. However, holster 20 can be used with a wide variety of hot melt dispensing handguns. The configuration of handgun 30 shown in FIG. 4 is referred to as a bottom-feed configuration due to the location where the heated hose 28 is mechanically and fluidicly coupled to handgun 30. Handgun 30 includes a grip 70, a barrel 72 integral with grip 70, a connecting member 74 extending between grip 70 and barrel 72 and a nozzle 76 releasably secured, such as by threading, to a distal end of barrel 72.

The heated hose 28 can be mechanically and fluidicly coupled to the barrel 72 of handgun 30 by conventional means such as mating hydraulic connectors 80 and 82. Nozzle 76 can have a variety of configurations to adapt to the particular production requirements. In the illustrative embodiment, nozzle 76 has a generally conical shape and is referred to as an extension nozzle which can be used to apply the hot melt material in hard to reach locations, such as the corner of a piece of furniture for example. Handgun 30 further includes a trigger 84. When an operator depresses trigger 84, pump 24 is turned on and a normally closed valve (not shown) inside barrel 72 opens so that, during operation of system 10, the hot melt material is pumped through heated hose 28 to handgun 30 and is discharged from handgun 30 through nozzle 76, or a nozzle having a different configuration, onto a work piece.

Handgun 30 can be inserted into holster 20 as shown in FIG. 4 and temporarily stored in holster 20 until a subsequent use of handgun 30. When sensors 64, 66, or other alternative sensors such as those discussed previously, sense the presence of handgun 30 within the cavity 36 of holster 20 the sensors are operable for sending a signal to an associated controller (not shown) or other logic circuitry that activates or turns on heating element 41, the PTC material, or other heating element(s) of nozzle garage 38 or any heating element of nozzle garage 38*a* to maintain the hot melt material within nozzle 76 at the desired temperature when handgun 30 is not being used. Additionally, if pump 24 is supplying a single handgun 30, the associated controller will shutdown pump 24 if it is operating and open the pressure dump valve 29 located downstream of pump 24 such that pressurized material can be recirculated to melter 22 and the pressure within hose 28 is relieved. This control of pump 24 overrides any signal created by depressing trigger 84 so that any inadvertent depression of trigger 84 when handgun 30 is within cavity 36 of holster 20 will not turn on pump 24. System 10 can include a plurality of handguns 30 and each could be supplied by one pump, such as pump 24. In this event, the associated controller can include logic that permits the operation of one or more handguns 30 when at least one other handgun 30 is stored within the respective holster 20. For example, logic can be included that will not shutdown pump 24 unless the presence of each handgun 30 is detected within the respective holster 20, or unless a flow sensor indicates material flow to one or more handguns 30 when the handguns 30 are located within the respective holster 20, which is an indication of an inadvertent discharge of the "holstered" handgun(s) 30.

In FIG. 4 the handgun 30 is illustrated in phantom line at a position disposed above holster 20 and is shown in solid line in a position disposed within cavity 36 of body 34 of holster 20. The open end 54 of body 34 of holster 20 accommodates a bottom-feed dispensing handgun such as handgun 30. More particularly, open end 54 permits handgun 30 to be inserted into cavity 36 with the heated hose 28 coupled to a lower portion of barrel 72 of handgun 30 such as the location shown in FIG. 4. Holster 20 is constructed so it can support the weight of handgun 30 with the heated hose 28 coupled to handgun 30. As shown in FIG. 4, nozzle 76 of handgun 30 is disposed within the hollow interior 40 of nozzle garage 38 and a portion of barrel 72 of handgun 30 is disposed within cavity 36. Body 34 of holster 20 has an ergonomic shape that complements the shape(s) of the handgun(s) to be used with holster 20. Accordingly, the shape of body 34 reduces operator fatigue and discomfort.

In the illustrative embodiment, end 52 of body 34 is inclined relative to vertical so that barrel 72 of handgun 30 can rest against an inner surface of end 52 of body 34. The bottom 44 of body 34 also supports handgun 30 in the area corresponding generally to fillet radius 45 and can also support a portion of hose 28 as shown in FIG. 4. However, body 34 can have shapes other than that shown to support handgun 30, with hose 28 coupled to handgun 30. Holster 20 can also include one or more support members (not shown) secured to body 34 for the purpose of supporting handgun 30 and/or hose 28. As shown in FIG. 2, body 34 has a "fast draw" configuration with the grip 70 disposed above body 34 when handgun 30 is in the stored position in holster 20, which provides an operator easy access to grip 70 for easy removal of handgun 30.

Handgun 30 can include at least one heater element (not shown) disposed within barrel 72 to maintain the hot melt material at the desired temperature during storage of handgun 30. Electrical wires associated with the heater element(s) can be routed through a hollow interior of grip 70 to a quick disconnect electrical connector 90 secured to a proximal end of grip 70 and coupled to a cord set 92. Body 34 of holster 20 can be made of a material that is a thermal insulator to assist in maintaining the hot melt material within barrel 72 at the desired temperature and to ensure that an exterior surface of body 34 is relatively cool "to the touch". Examples of materials that can be used to make body 34 include, but are not limited to, various plastic materials including molded plastic materials and various composite materials including fiber glass. The housing 39 of nozzle garage 38, which is releasably secured to body 34, can be made of a PTC material as discussed previously. Alternatively, housing 39 can be made of metal to facilitate conduction heat transfer through housing 39 as a result of heating element 41 embedded in housing 39, or other heating elements of housing 39. In this case, a sleeve (not shown) made of a thermal insulator can be disposed in surrounding relationship with housing 39 to provide an external surface that is at an acceptable temperature, i.e., is relatively cool to the touch. Body 34*a* and nozzle garage 38*a*, which are integrally formed with one another, can be made of a plastic-based PTC material. Since the heating element(s) of nozzle garage 38 or nozzle garage 38*a* maintains the hot melt material within nozzle 76 of handgun 30 at the desired temperature during storage of handgun 30, which results in the desired viscosity and flow characteristics, it is not necessary for the operator to purge material out of nozzle 76 before the next use of handgun 30. This results in a savings in material cost and eliminates production line "down time" associated with handgun nozzle purging. The wires (not shown) associated with heating element 41 and the wires associated with sensor 42, can be electrically coupled to a cord set 94 that extends away from nozzle garage 38, and can be electrically coupled to a controller (not shown) as discussed previously. Separate cord sets 92, 94 are used for handgun 30 and nozzle garage 38, respectively, to accommodate holster 20 being mounted to a fixed structure such as work table 32 while permitting handgun 30 to be moved, within the limits imposed by the length of heated hose 28, during operation of system 10. When a PTC material is used, any wires (not shown) used to electrically couple the PTC material to a power supply (not shown) can also be routed away from nozzle garage 38, separate from cord set 92, in a manner that does not inhibit the movement of handgun 30 during operation of system 10.

Figure 5:
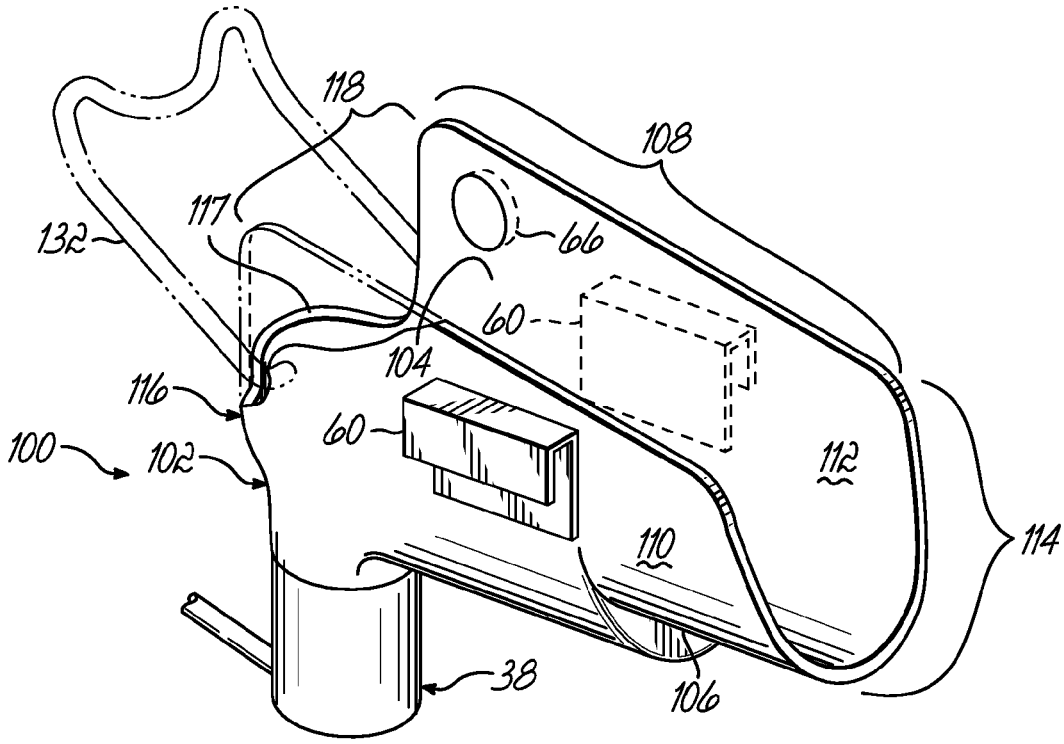
FIG. 5 is a perspective view of a holster according to another embodiment of the present invention.
Figure 5A:
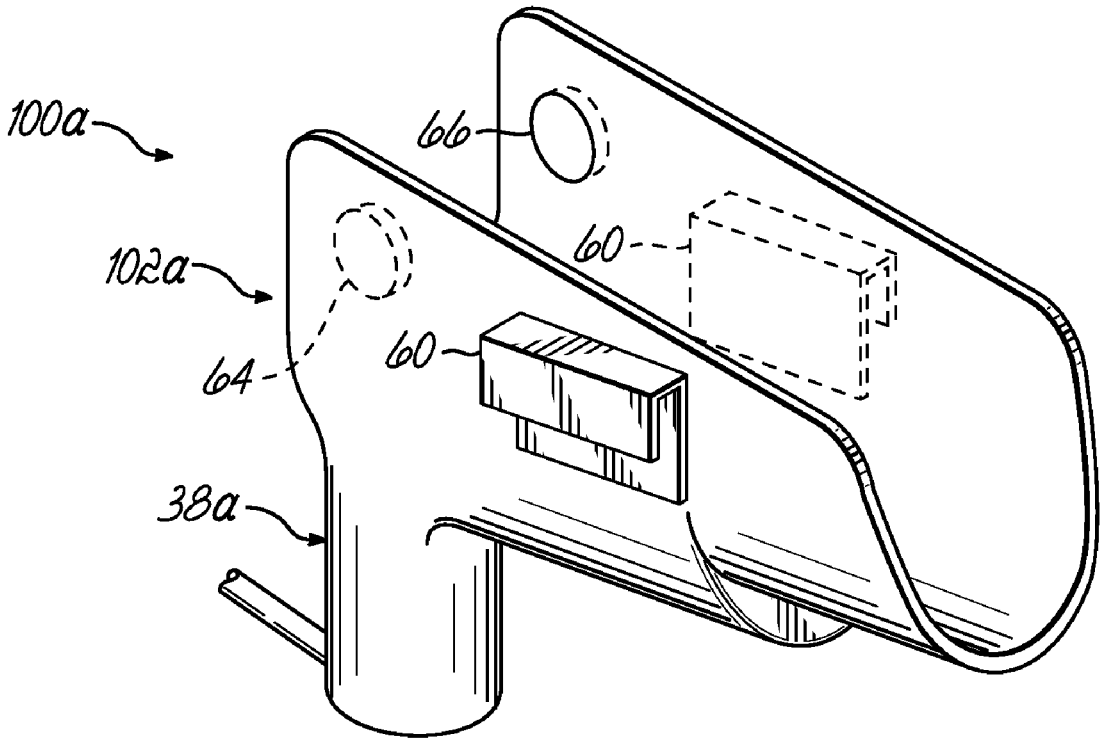
FIG. 5A is a perspective view of a holster according to another embodiment of the present invention.
Figure 6:
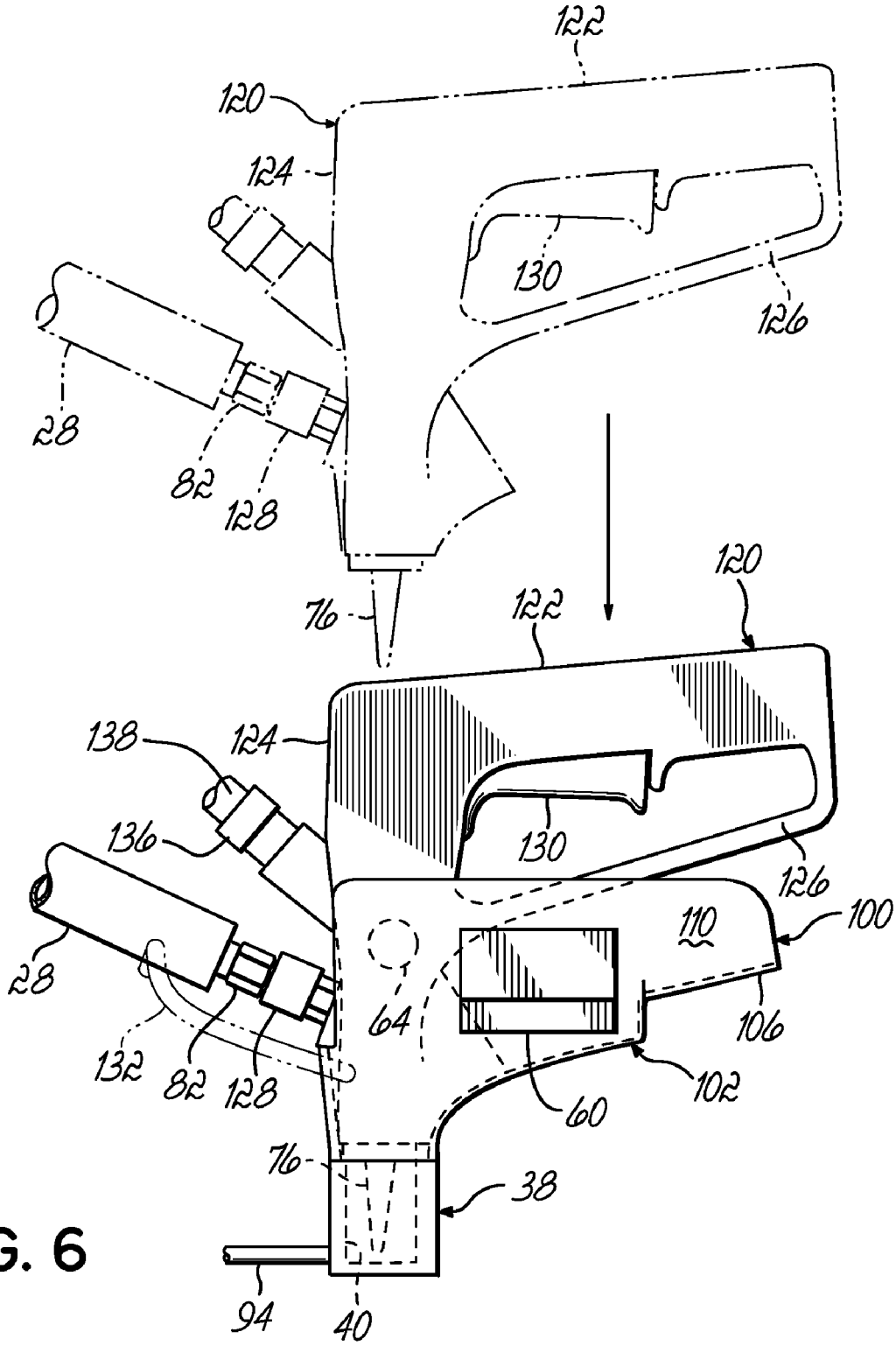
FIG. 6 is a side elevation view of the holster shown in FIG. 5, illustrating a hot melt dispensing handgun being inserted into the holster.

FIGS. 5 and 6 illustrate a holster 100 according to another embodiment. Holster 100 includes a body 102 defining a cavity 104 and further includes the nozzle garage 38 discussed previously with respect to holster 20. Similar to holster 20, nozzle garage 38 of holster 100 can be releasably secured to body 102 of holster 100. For example, as discussed previously with respect to nozzle 20, the nozzle garage 38 of holster 100 can be threaded onto body 102 or can be releasably secured to body 102 using other means. Alternatively, the body and nozzle garage can be integrally formed with one another as a one-piece construction as shown in FIG. 5A with regard to holster 100*a*. Holster 100*a* includes body 102*a* and nozzle garage 38*a* that are integrally formed with one another and accordingly do not include mating threads but can otherwise be configured generally the same as body 102 and nozzle garage 38, respectively. Bodies 102 and 102*a* can be made of the materials that can be used to make body 34 and body 34*a*, respectively, discussed previously.

In the illustrative embodiment, body 102 of holster 100 includes a bottom 106, an open top 108, first 110 and second 112 sides extending between bottom 106 and top 108, an open end 114 and a partially open end 116. End 116 has a lower, closed portion 117 and an upper, open portion 118. Since holster 100 includes one open end and one partially open end, as compared to holster 20 that has an open end and a closed end, holster 100 can accommodate a bottom-feed dispensing handgun such as handgun 30 illustrated schematically in FIGS. 1 and 4, and holster 100 can also accommodate a top-feed dispensing handgun such as handgun 120 illustrated schematically in FIG. 6. Alternatively, a holster can be configured to accommodate a top-feed configuration handgun but not a bottom-feed configuration handgun, for example if end 114 in the illustrative embodiment would be closed instead of open.

Holster 100 further includes at least one mounting device that is operable for releasably mounting holster 100 on a structure such as work table 32. In the illustrative embodiment, holster 100 includes two of the mounting devices 60 also included in holster 20 and discussed previously, with one mounting device 60 secured to side 110 and the other mounting device 60 secured to side 112 of body 102. However, a variety of other mounting devices can be secured to sides 110, 112 of body 102 that can include brackets having other configurations, snaps, straps, pins, cables and other suitable devices. Holster 100 can be releasably or fixedly mounted on a structure such as work table 32.

Holster 100 can also include a proximity sensor that may include sensors 64, 66 discussed previously and illustrated schematically in FIGS. 5, 5A and 6, or other alternative sensors or switches including those discussed previously with respect to holster 20, which are operable for sensing or detecting the presence of handgun 120 within cavity 104 of holster 100. A controller (not shown) coupled to the proximity sensor of holster 100, or to the sensors of each holster 100 when multiple handguns 120 are supplied by pump 24, can include the required logic to shutdown pump 24, open pressure dump valve 29 and activate or turn on the heating element(s) of nozzle garage 38 or nozzle garage 38*a*, in the same manner as that discussed previously with respect to the operation of one or more handguns 30.

Holster 100 and handgun 120 can be used in system 10 shown in FIG. 1 or other similar systems. The handgun 120 illustrated schematically in FIG. 6 is also a Series AD-41 Dispensing Handgun made by Nordson Corporation, which is the assignee of the present invention. As noted previously, handgun 120 is a top-feed configuration handgun due to the location where the heated hose 28 is mechanically and fluidicly coupled to handgun 120. Handgun 120 includes a grip 122, a barrel 124 integral with grip 122, a connecting member 126 extending between grip 122 and barrel 124 and a nozzle, such as nozzle 76 discussed previously, releasably secured to a distal end of barrel 124. Barrel 124 is configured so that a fluid conduit such as heated hose 28 can be routed from an overhead location to handgun 120, and mechanically and fluidicly coupled to an upper portion of the barrel 124 of handgun 120, such as the location shown in FIG. 6, by conventional means. For example, hose 28 can be coupled to handgun 120 with mating hydraulic connectors, such as connector 128 secured to barrel 124 and connector 82 secured to hose 28. Handgun 120 further includes a trigger 130. When an operator depresses trigger 130, pump 24 of system 10 is turned on and a normally closed valve (not shown) inside barrel 124 opens. Accordingly, during operation of system 10, the hot melt material is pumped through heated hose 28 to handgun 120 and is discharged from handgun 120 through nozzle 76, or a nozzle having a different configuration, onto a work piece.

When system 10 is inactive, with pump 24 off, handgun 120 can be inserted into holster 100 as shown in FIG. 6. More particularly, in FIG. 6 the handgun 120 is illustrated in phantom line at a position disposed above holster 100 and is shown in solid line in a position disposed within cavity 104 of body 102 of holster 100. Holster 100 is constructed so it can support handgun 120, with the heated hose 28 coupled to handgun 120. More particularly, holster 100 has sufficient mechanical strength so it can support the combined weight of handgun 100 and any material therein, as well as the load applied to handgun 100 by heated hose 28. As shown in FIG. 6, handgun 120 is in contacting engagement with bottom 106 of holster 100 when stored within holster 100.

The partially open end 116 accommodates the top-feed configuration of handgun 120 shown in FIG. 6. As shown in FIG. 6, nozzle 76 of handgun 120 is disposed within the hollow interior 40 of nozzle garage 38 and a portion of barrel 124 of handgun 120 is disposed within cavity 104 of body 102, with body 102 supporting handgun 120. Since end 114 is open, holster 100 can also receive a bottom-feed configuration handgun such as handgun 30 discussed previously, with the heated hose 28 extending away from the barrel 72 of handgun 30 through the open end 114.

Similar to holster 20, the body 102 of holster 100 has an ergonomic shape that complements the shape(s) of the handgun(s) to be used with holster 100. Accordingly, the shape of body 102 reduces operator fatigue and discomfort. Holster 100 can also include one or more support members, such as support member 132, secured to body 102 for the purpose of supporting handgun 120 and/or hose 28. Also, the body 102 of holster 100 has a "fast draw" configuration, with grip 122 disposed above body 102, which provides an operator easy access to grip 122 for easy removal of handgun 120 from holster 100.

Handgun 120 can include at least one heater element (not shown) disposed within barrel 124 to maintain the hot melt material therein at the desired temperature during storage of handgun 120 within holster 100. Nozzle garage 38 maintains the hot melt material within nozzle 76 at the desired temperature when handgun 120 is inactive and is stored within holster 100. Electrical wires associated with the heater element(s) can be routed through the barrel 124 to a quick disconnect electrical connector 136 that is coupled to a cord set 138. The cord set 138 is separate from the cord set 94 associated with nozzle garage 38, for the reasons presented previously with respect to holster 20 and handgun 30. The use of holster 100 eliminates the need for an operator to purge material out of nozzle 76 before the next use of handgun 120. This results in a savings of material costs and eliminates production line "down time" associated with handgun nozzle purging.

While the foregoing description has set forth illustrative embodiments of the present invention in particular detail, it must be understood that numerous modifications, substitutions and changes can be undertaken without departing from the true spirit and scope of the present invention as defined by the ensuing claims. The invention is therefore not limited to specific embodiments as described, but is only limited as defined by the following claims.

What is claimed is:

1. A holster for use with a hot melt dispensing handgun, said holster comprising:

a body defining a cavity, said body being adapted to receive at least a portion of a handgun within said cavity and for supporting the handgun when the handgun is inactive; and a nozzle garage comprising a housing defining a hollow interior communicating with said cavity and further comprising a heating element, said nozzle garage being adapted to receive at least a portion of a nozzle of the handgun within said hollow interior and operable for heating the nozzle when the handgun is inactive.

2. A holster as recited in claim 1, further comprising:

at least one mounting device secured to said body, said at least one mounting device being adapted to mount said holster on a structure.

3. A holster as recited in claim 2, wherein said body comprises first and second sides and said at least one mounting device comprises a pair of mounting devices, each of said mounting devices being secured to one of said sides.

4. A holster as recited in claim 1, wherein said nozzle garage is releasably secured to said body.

5. A holster as recited in claim 1, wherein said housing of said nozzle garage and said body are integrally formed as a one-piece construction.

6. A holster as recited in claim 1, wherein said body is made of a thermal insulator.

7. A holster as recited in claim 1, wherein:

said body comprises an open top and an open end, wherein the at least a portion of the handgun is insertable into said cavity through said open top, said body being adapted to receive at least a portion of a barrel of the handgun within said cavity; and said open end is adapted to permit a conduit to be coupled to the barrel of the handgun when the barrel is at least partially disposed within said cavity.

8. A holster as recited in claim 1, wherein:

said body comprises an open top and a partially open end, wherein the at least a portion of the handgun is insertable into said cavity through said open top, said body being adapted to receive at least a portion of a barrel of the handgun within said cavity; and said partially open end is adapted to permit a conduit to be coupled to the barrel of the handgun when the barrel is at least partially disposed within said cavity.

9. A holster as recited in claim 8, wherein said body further comprises a second end, said second end being open.

10. A holster as recited in claim 1, wherein said heating element is a cartridge heater embedded in said housing.

11. A holster as recited in claim 1, wherein said housing comprises a positive-temperature-coefficient material, said positive-temperature-coefficient material being said heating element.

12. A holster as recited in claim 1, further comprising:

at least one sensor operable for sensing the presence of the handgun within said cavity.

13. A holster as recited in claim 12, wherein:

said at least one sensor is operable for sending a signal to a controller which activates said heating element when the presence of the handgun within said cavity is sensed.

14. A holster as recited in claim 1, wherein said body comprises an open top, and the portion of the nozzle is insertable into said hollow interior through said open top and said cavity.

15. A holster as recited in claim 1, wherein said body further comprises a bottom wall, an open top, first and second sides extending between said bottom wall and said open top, and a closed end extending between said first and second sides from said bottom wall to said open top.

16. A holster as recited in claim 15, wherein said nozzle garage is disposed below said first and second sides and said closed end such that said hollow interior is in communication with said cavity generally at the intersection of said closed end and said first and second sides.

17. A hot melt dispensing system comprising:

a hot melt dispensing handgun comprising a nozzle;

a holster comprising a body defining a cavity, said body being adapted to receive at least a portion of said handgun within said cavity and for supporting said handgun when said handgun is inactive; wherein said holster further comprises a nozzle garage, said nozzle garage comprising a housing defining a hollow interior communicating with said cavity and further comprising a heating element, said nozzle garage being adapted to receive at least a portion of said nozzle of said handgun within said hollow interior and operable for heating said nozzle when said handgun is inactive.

18. A hot melt dispensing system comprising:

a hot melt dispensing handgun including a nozzle;

a holster comprising a body defining a cavity, said body being adapted to receive at least a portion of said handgun within said cavity and for supporting said handgun when said handgun is inactive, wherein said holster further comprises a nozzle garage, said nozzle garage comprising a housing defining a hollow interior communicating with said cavity and further comprising a heating element, said nozzle garage being adapted to receive at least a portion of said nozzle of said handgun within said hollow interior and operable for heating said nozzle when said handgun is inactive; wherein said handgun further comprises a barrel, said nozzle being releasably secured to said barrel;

said system further comprises a heated hose mechanically and fluidicly coupled to said barrel of said handgun and a pump in fluid communication with said heated hose, said heated hose being operable for delivering hot melt material to said barrel;

said body comprises an open top for receiving said nozzle and at least a portion of said barrel therethrough; and said body further comprises an open end permitting the coupling of said conduit to said barrel of said handgun when said at least a portion of said barrel is disposed within said cavity, said heated hose extending from said barrel of said handgun through said open end.

19. A hot melt dispensing system as recited in claim 17, wherein said holster further comprises at least one mounting device secured to said body, said at least one mounting device being operable for mounting said holster on a structure.

20. A hot melt dispensing system as recited in claim 17, wherein said body of said holster is made of a thermal insulator.

21. A hot melt dispensing system as recited in claim 17, wherein said heating element is a cartridge heater embedded in said housing.

22. A hot melt dispensing system as recited in claim 17, wherein said housing comprises a positive-temperature-coefficient material, said positive-temperature-coefficient material being said heating element.

23. A hot melt dispensing system as recited in claim 17, further comprising:

at least one sensor operable for sensing the presence of said handgun within said cavity of said holster and for sending a signal to a controller which activates said heating element when the presence of said handgun within said cavity is sensed.

24. A holster as recited in claim 17, wherein said body comprises an open top, and the portion of the nozzle is insertable into said hollow interior through said open top and said cavity.

25. A holster as recited in claim 17, wherein said body further comprises a bottom wall, an open top, first and second sides extending between said bottom wall and said open top, and a closed end extending between said first and second sides from said bottom wall to said open top.

26. A holster as recited in claim 25, wherein said nozzle garage is disposed directly below said first and second sides and said closed end such that said hollow interior is in communication with said cavity at the intersection of said closed end and said first and second sides.

* * * * *